US009122193B2

(12) United States Patent
Yoneima et al.

(10) Patent No.: US 9,122,193 B2
(45) Date of Patent: Sep. 1, 2015

(54) DEVELOPING ROLLER, DEVELOPING DEVICE, AND IMAGE FORMING APPARATUS INCLUDING DEVELOPING DEVICE

(71) Applicant: KYOCERA Document Solutions Inc., Osaka-shi, Osaka (JP)

(72) Inventors: Yoshinobu Yoneima, Osaka (JP); Yuji Kamiyama, Osaka (JP); Akihiro Watanabe, Osaka (JP); Tamotsu Shimizu, Osaka (JP); Shizuka Okada, Osaka (JP); Sakae Saito, Osaka (JP); Yasuhiro Oishi, Osaka (JP); Chikara Ishihara, Osaka (JP); Masashi Fujishima, Osaka (JP); Yoshimi Shimizu, Osaka (JP); Yasuhiro Tauchi, Osaka (JP); Yu Sasaki, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/571,152

(22) Filed: Dec. 15, 2014

(65) Prior Publication Data

US 2015/0177642 A1 Jun. 25, 2015

(30) Foreign Application Priority Data

Dec. 20, 2013 (JP) ..... 2013-264428

(51) Int. Cl.
*G03G 15/09* (2006.01)
*G03G 15/08* (2006.01)

(52) U.S. Cl.
CPC ..... *G03G 15/0808* (2013.01); *G03G 15/09* (2013.01)

(58) Field of Classification Search
CPC ..... G03G 15/09; G03G 15/0808
USPC ..... 399/276
See application file for complete search history.

(56) References Cited

FOREIGN PATENT DOCUMENTS

JP 2009251272 A 10/2009
JP 2010197945 A 9/2010

*Primary Examiner* — David Bolduc
*Assistant Examiner* — Barnabas Fekete
(74) *Attorney, Agent, or Firm* — Alleman Hall McCoy Russell & Tuttle LLP

(57) ABSTRACT

A developing roller includes a roller main body disposed to face, without contact, an outer circumferential surface of an image carrier. A resin coat layer has been formed on an outer circumferential surface of the roller main body, the resin coat layer being made of a resin material having electric conductivity. A product of resistance component Rs [Ω] and electrostatic capacitance component Cs [F] in AC impedance Z of the roller main body is in a range from $2.79\times10^{-7}$ to $6.77\times10^{-5}$, the AC impedance Z being obtained when an AC voltage of a predetermined frequency f is applied.

10 Claims, 6 Drawing Sheets

FIG. 5

| | TITANIUM OXIDE | | RESIN COAT | | Ra | Rs | Cs | RsCs | DEVELOP ABILITY | CONTAMINATION RESISTANCE | 1Dot6.25% HALF REPRODUCIBILITY |
|---|---|---|---|---|---|---|---|---|---|---|---|
| | TYPE | PTS.WT. | TYPE | μm | μm | Ω | F | 3.7kHz | | | |
| CF1 | ET300W | 150 | NYLON | 13.0 | 0.313 | 2.74E+03 | 2.76E-08 | 7.56E-05 | × | △ | × |
| CF2 | ET300W | 200 | NYLON | 5.2 | 0.383 | 2.21E+03 | 3.36E-08 | 7.43E-05 | ○ | △ | × |
| CF3 | ET300W | 150 | NYLON | 5.1 | 0.334 | 3.18E+03 | 2.32E-08 | 7.39E-05 | ○ | △ | × |
| EX1 | ET300W | 125 | NYLON | 6.8 | 0.142 | 1.34E+04 | 1.67E-09 | 2.24E-05 | ○ | ○ | ○ |
| EX2 | ET300W | 100 | NYLON | 2.2 | 0.182 | 2.37E+04 | 1.83E-11 | 4.35E-07 | ○ | ○ | ○ |
| EX3 | ET300W | 100 | NYLON | 2.3 | 0.278 | 4.40E+03 | 1.58E-09 | 6.98E-06 | ○ | ○ | ○ |
| EX4 | ET300W | 100 | NYLON | 6.1 | 0.160 | 3.28E+04 | 1.80E-11 | 5.89E-07 | ○ | ○ | ○ |
| EX5 | ET300W | 100 | NYLON | 7.2 | 0.142 | 1.52E+04 | 5.07E-10 | 7.73E-06 | ○ | ○ | ○ |
| EX6 | ET300W | 100 | NYLON | 7.8 | 0.216 | 1.34E+04 | 1.27E-09 | 1.70E-05 | ○ | ○ | ○ |
| EX7 | ET300W | 50 | NYLON | 2.2 | 0.200 | 2.81E+04 | 1.46E-11 | 4.09E-07 | ○ | ○ | ○ |
| EX8 | ET300W | 50 | NYLON | 2.1 | 0.279 | 1.89E+04 | 1.48E-11 | 2.79E-07 | ○ | ○ | ○ |
| EX9 | ET300W | 50 | NYLON | 5.6 | 0.131 | 5.34E+03 | 7.22E-10 | 3.86E-06 | ○ | ○ | ○ |
| EX10 | ET300W | 50 | NYLON | 6.3 | 0.229 | 1.11E+04 | 3.12E-11 | 3.45E-07 | ○ | ○ | ○ |
| EX11 | ET300W | 50 | NYLON | 7.2 | 0.137 | 5.53E+03 | 5.75E-10 | 3.18E-06 | ○ | ○ | ○ |
| EX12 | SMT-A | 100 | NYLON | 4.4 | 0.156 | 1.98E+04 | 4.10E-11 | 8.11E-07 | ○ | ○ | ○ |
| EX13 | SMT-A | 100 | NYLON | 7.6 | 0.185 | 5.35E+03 | 5.07E-10 | 2.71E-06 | ○ | ○ | ○ |
| EX14 | SMT-A | 50 | NYLON | 1.7 | 0.263 | 2.76E+04 | 1.99E-11 | 5.51E-07 | ○ | ○ | ○ |
| EX15 | SMT-A | 50 | NYLON | 5.8 | 0.162 | 5.95E+03 | 5.99E-10 | 3.57E-06 | ○ | ○ | ○ |
| EX16 | SMT-A | 50 | NYLON | 7.4 | 0.151 | 5.50E+03 | 5.89E-10 | 3.24E-06 | ○ | ○ | ○ |
| EX17 | ET300W | 150 | NYLON | 11.0 | 0.100 | 2.45E+03 | 2.76E-08 | 6.77E-05 | △ | △ | ○ |

DEVELOPING ROLLER, DEVELOPING DEVICE, AND IMAGE FORMING APPARATUS INCLUDING DEVELOPING DEVICE

INCORPORATION BY REFERENCE

This application is based upon and claims the benefit of priority from the corresponding Japanese Patent Application No. 2013-264428 filed on Dec. 20, 2013, the entire contents of which are incorporated herein by reference.

BACKGROUND

The present disclosure relates to a technology of a developing roller that is disposed to face, without contact, the outer circumferential surface of the image carrier.

A developing device is installed in an image forming apparatus which is a copier, a printer or the like and forms an image on a paper sheet based on the electrophotography. The developing device develops, by toner, an electrostatic latent image formed on an image carrier such as a photoconductor drum. As the developing method, a so-called two-component developing method is known which uses two-component developer including magnetic carrier and toner to develop a toner image on the image carrier. As an example of the two-component developing method, there is conventionally known a contactless developing system called "interactive touchdown developing system". In the interactive touchdown developing system, a developing roller and a magnetic roller are used. The developing roller is disposed at a predetermined distance from the image carrier. A magnet is embedded in the magnetic roller. The magnetic roller draws up the magnetic carrier as well as the toner, and holds them on the surface thereof. The magnetic roller forms a magnetic brush thereon to transfer only the toner to the developing roller, and form a toner thin layer on the developing roller. An AC electric field is generated by a developing bias including an AC component applied to the developing roller, and the AC electric field flies the toner from the developing roller and causes the toner to adhere to the electrostatic latent image on the image carrier.

Meanwhile, the developing device is required to have high developability. That is, the developing device is required to surely cause toner to be flown from the developing roller and adhered to the electrostatic latent image on the image carrier. To improve the developability, the resistance of the developing roller may be decreased to increase the magnitude of the developing electric field (an electric field between the developing roller and the photoconductor drum). However, when the resistance of the developing roller is decreased, the adhesion (image force) of toner not having been used in the developing to the surface of the developing roller increases, thereby it becomes difficult for the not-used toner to separate from the developing roller. When the toner carried on the surface of the developing roller is held there for a long time without being separated, a toner filming occurs to the surface of the developing roller, resulting in a roller contamination. On the other hand, when the image force is reduced, it becomes easy for the toner to separate, the roller contamination by the toner filming is restricted, and the contamination resistance is improved. However, when the image force is reduced, the toner easily separates from the developing roller and unnecessarily adheres to the image carrier. In that case, a toner fogging occurs and the developability by the toner is decreased.

SUMMARY

A developing roller according to an aspect of the present disclosure includes a roller main body disposed to face, without contact, an outer circumferential surface of an image carrier. A resin coat layer has been formed on an outer circumferential surface of the roller main body, the resin coat layer being made of a resin material having electric conductivity. A product of resistance component Rs [Ω] and electrostatic capacitance component Cs [F] in AC impedance Z of the roller main body is in a range from $2.79\times10^{-7}$ to $6.77\times10^{-5}$, the AC impedance Z being obtained when an AC voltage of a predetermined frequency f is applied.

A developing device according to another aspect of the present disclosure includes the developing roller and a magnetic roller. The magnetic roller forms a toner layer on a surface of the developing roller via a magnetic brush composed of toner and magnetic carrier.

An image forming apparatus according to a further aspect of the present disclosure includes the developing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 5 is a table showing comparative examples 1 to 3 (CF1-3) and examples 1 to 17 (EX1-17) of the developing sleeve.

DETAILED DESCRIPTION

The following describes embodiments of the present disclosure with reference to the drawings as appropriate. It should be noted that the following embodiments are only examples of specific embodiments of the present disclosure and can be varied as appropriate without changing the gist of the present disclosure.

Figure 1:
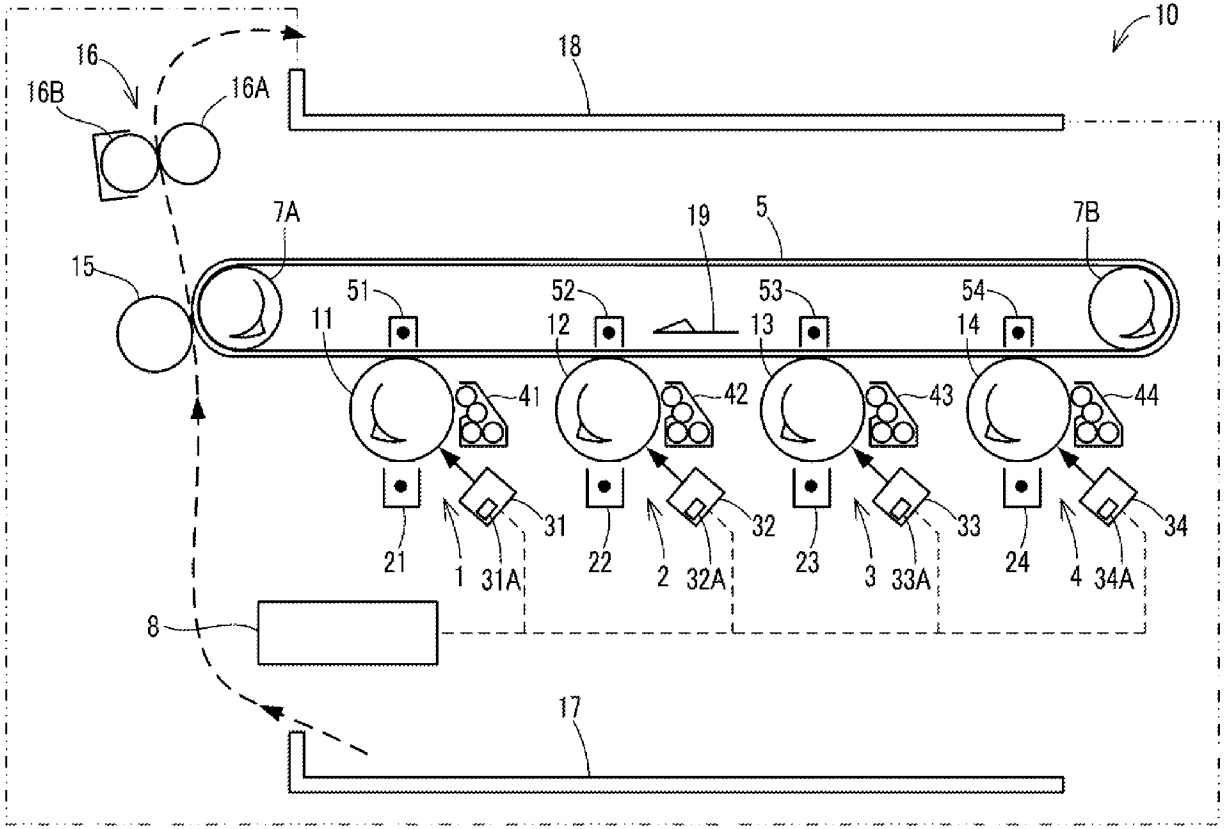
FIG. 1 is a schematic diagram showing the configuration of the image forming apparatus in an embodiment of the present disclosure.

FIG. 1 is a schematic diagram showing an outlined configuration of an image forming apparatus 10 (an example of the image forming apparatus of the present disclosure) in an embodiment of the present disclosure. As shown in FIG. 1, the image forming apparatus 10 is a so-called tandem color image forming apparatus, and includes a plurality of image forming portions 1-4, an intermediate transfer belt 5, a driving roller 7A, a driven roller 7B, a secondary transfer device 15, a fixing device 16, a control portion 8, a sheet feed tray 17, and a sheet discharge tray 18. It is noted that specific examples of the image forming apparatus 10 in an embodiment of the present disclosure are a copier, a facsimile, a printer that can form a color image or a monochrome image, and a multifunction peripheral having these functions.

The image forming portions 1-4 form images based on the electrophotography. The image forming portions 1-4 form toner images of different colors respectively on a plurality of photoconductor drums 11-14 arranged in an alignment (an example of the image carrier of the present disclosure), and transfer the toner images onto the intermediate transfer belt 5 in sequence while the intermediate transfer belt 5 is running (moving) so that the images are overlaid with each other. In an example shown in FIG. 1, in order from the downstream side in the movement direction (the direction indicated by arrow 19) of the intermediate transfer belt 5, an image forming portion 1 for black, an image forming portion 2 for yellow, an image forming portion 3 for cyan, and an image forming portion 4 for magenta are arranged in a row in the stated order.

The image forming portions 1-4 include the photoconductor drums 11-14, charging devices 21-24, exposure devices 31-34, developing devices 41-44 (an example of the developing device of the present disclosure), first transfer devices 51-54 and the like, respectively. The photoconductor drums 11-14 carry toner images on the surfaces thereof. The charging devices 21-24 charge the surfaces of the corresponding photoconductor drums 11-14 to a predetermined potential. The exposure devices 31-34 write electrostatic latent images on the charged surfaces of the photoconductor drums 11-14 by exposing the surfaces to light that is scanned thereon. The developing devices 41-44 develop the electrostatic latent images on the photoconductor drums 11-14 by toner. The first transfer devices 51-54 transfer the toner images from the rotating photoconductor drums 11-14 onto the intermediate transfer belt 5. It is noted that although not shown in FIG. 1, the image forming apparatuses 1-4 also include cleaning devices for removing remaining toner from the surfaces of the photoconductor drums 11-14.

The intermediate transfer belt 5 is, for example, a belt having a shape of an endless loop and is made of rubber, urethane or the like. The intermediate transfer belt 5 is supported by the driving roller 7A and the driven roller 7B so as to be driven and rotated. The driving roller 7A is located close to the fixing device 16 (on the left side in FIG. 1), and the driven roller 7B is located away from the fixing device 16 (on the right side in FIG. 1). The surface of the driving roller 7A is made of, for example, a material such as rubber, urethane or the like that increases friction force with the intermediate transfer belt 5. Being supported by the driving roller 7A and the driven roller 7B, the intermediate transfer belt 5 moves (runs), with its surface contacting with the surfaces of the photoconductor drums 11-14. When the intermediate transfer belt 5 passes between the photoconductor drums 11-14 and the first transfer devices 51-54, the toner images are transferred in sequence from the photoconductor drums 11-14 onto the surface of the intermediate transfer belt 5 so that the images are overlaid with each other.

The second transfer device 15 transfers the toner image from the intermediate transfer belt 5 to a print sheet conveyed from the paper feed tray 17. The print sheet with the transferred toner image thereon is conveyed to the fixing device 16 by a conveyance device (not shown). The fixing device 16 includes a heating roller 16A heated to a high temperature and a pressure roller 16B. The pressure roller 16B is disposed to face the heating roller 16A. The print sheet conveyed to the fixing device 16 is conveyed while being nipped by the heating roller 16A and the pressure roller 16B. This allows the toner image to be fused and fixed to the print sheet. The print sheet is then ejected onto the ejected paper tray 18.

As described above, the image forming apparatus 10 forms a color toner image on the surface of the intermediate transfer belt 5 by causing the plurality of image forming portions 1-4 to transfer toner images of different colors onto the intermediate transfer belt 5 while the belt is running so that the toner images are overlaid with each other. Furthermore, the image forming apparatus 10 forms a color image on a print sheet by causing the second transfer device 15 to transfer the toner image from the intermediate transfer belt 5 to the print sheet. Note that, as another embodiment, the intermediate transfer belt 5 may be used as a conveyance belt, and the toner images may be overlaid with each other directly on a print sheet while the paper sheet is conveyed by the conveyance belt. Also, as a still another embodiment, an intermediate transfer member shaped like a roller may be used in place of the intermediate transfer belt 5.

The control portion 8 comprehensively controls the image forming apparatus 10. The control portion 8 includes a CPU, a ROM, a RAM, an EEPROM, a motor driver, and the like. The RAM is a volatile storage medium, and the EEPROM is a nonvolatile storage medium. The RAM and the EEPROM are used as temporary storage memories for the various types of processes executed by the CPU. The motor driver drives and controls various types of motors (not shown) based on control signals received from the CPU.

Figure 2:
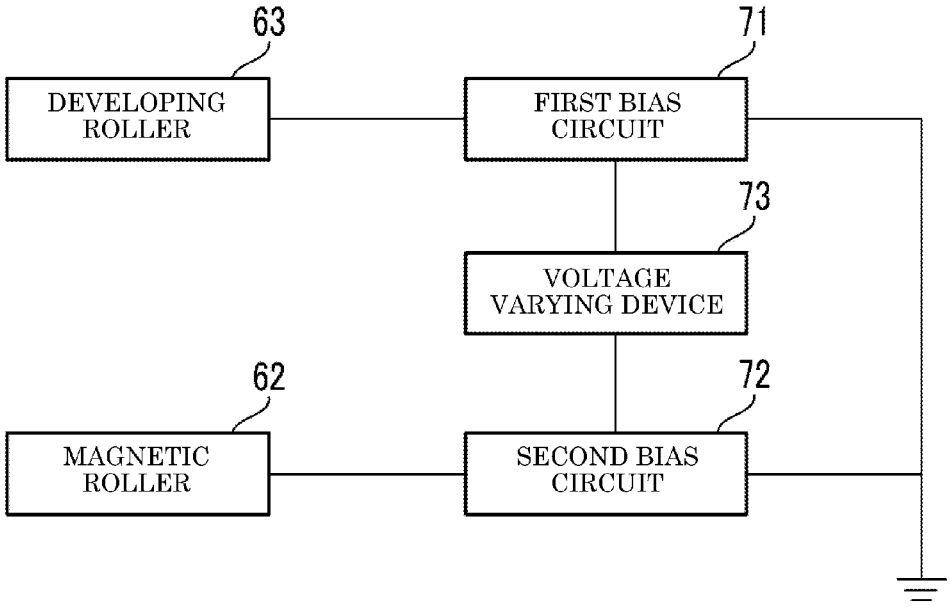
FIG. 2 is a block diagram showing the configuration of the control portion included in the image forming apparatus of FIG. 1.

As shown in FIG. 2, the control portion 8 includes a first bias circuit 71, a second bias circuit 72, and a voltage varying device 73. The first bias circuit 71 applies a voltage to a developing roller 63 which is included in each of the developing devices 41-44 (see FIG. 3). The second bias circuit 72 applies a voltage to a magnetic roller 62 which is included in each of the developing devices 41-44 (see FIG. 3). The voltage varying device 73 varies the voltages applied to the developing roller 63 and the magnetic roller 62.

Figure 3:
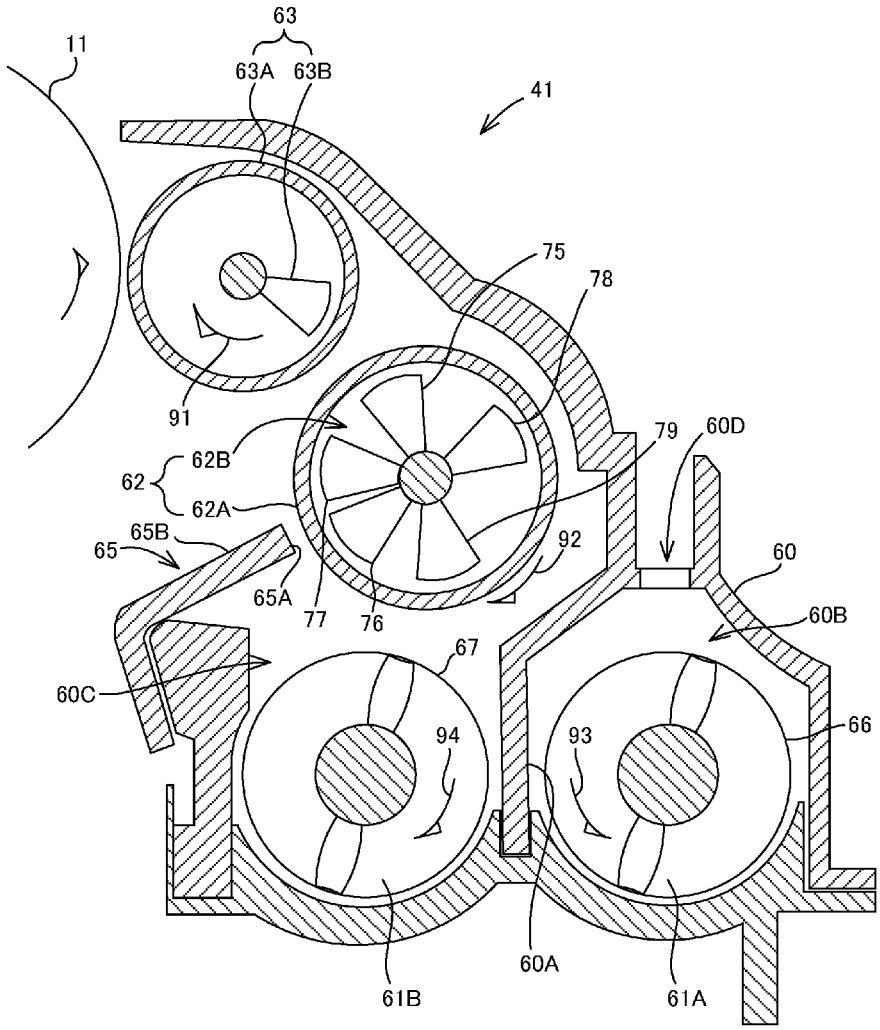
FIG. 3 is a cross sectional view showing the configuration of the developing device in an embodiment of the present disclosure.

FIG. 3 is a cross-sectional diagram showing the configuration of the developing device 41 included in the image forming portion 1. It is noted that the other developing devices 42-44 have the same configuration as the developing device 41, and detailed description thereof is omitted.

The developing device 41 develops images by a developing system called "interactive touchdown developing system" which causes toner to be adhered to the electrostatic latent image while the developing device is not contacting the photoconductor drum 11. As shown in FIG. 3, the developing device 41 includes a developer case 60 in which two-component developer (hereinafter also referred to merely as "developer") including toner is stored. The developer container 60 is partitioned into a first stirring chamber 60B and a second stirring chamber 60C by a partition wall 60A. Toner is stored in both the first stirring chamber 60B and the second stirring chamber 60C. In the first stirring chamber 60B and the second stirring chamber 60C, the first stirring screw 61A and the second stirring screw 61B are rotatably provided, respectively. The toner is supplied from a toner container (not shown) to the developer case 60, and the first stirring screw 61A and the second stirring screw 61B mix the toner with magnetic carrier and stir them to charge the toner.

The magnetic roller 62 and the developing roller 63 are provided in the developer container 60. The magnetic roller 62 holds, on its roller surface, the magnetic carrier adhered with the toner. The magnetic roller 62 forms a toner layer on the surface of the developing roller 63 via a magnetic brush, which, as described below, is composed of the magnetic carrier adhered with the toner. The developing roller 63 is disposed to face the magnetic roller 62. Specifically, the magnetic roller 62 is disposed above the second stirring screw 61B. The developing roller 63 is disposed at the upper left of the magnetic roller 62 to face the magnetic roller 62 with a predetermined gap therebetween. In addition, the developing roller 63 faces the photoconductor drum 11 at an opening 64 of the developer container 60 (at left in FIG. 3) with a predetermined gap therebetween. That is, the developing roller 63 is disposed to face the outer circumferential surface of the photoconductor drum 11. The magnetic roller 62 and the developing roller 63 are both rotated clockwise in FIG. 3 (see arrows 91, 92).

The magnetic roller 62 includes a non-magnetic rotating sleeve 62A and a magnetic-roller-side magnetic pole 62B that includes a plurality of magnetic poles. The rotating sleeve 62A is rotatably supported by a frame (not shown) of the developing device 41. The magnetic-roller-side magnetic pole 62B is contained in the rotating sleeve 62A. That is, the magnetic-roller-side magnetic pole 62B is provided inside the rotating sleeve 62A. The magnetic-roller-side magnetic pole 62B is fixed inside the rotating sleeve 62A. In the present embodiment, the magnetic-roller-side magnetic pole 62B has five magnetic poles: a main pole 75; a regulation pole (a brush-clipping magnetic pole) 76; a carrying pole 77; a peeling pole 78; and a draw-up pole 79. The magnetic poles 75-79 may be, for example, permanent magnets that generate magnetic forces.

The main pole 75 is attached to the magnetic-roller-side magnetic pole 62B such that the magnetic pole face of the main pole 75 faces the developing roller 63. The main pole 75 forms a magnetic field together with a developing-roller-side magnetic pole 63B, wherein in the magnetic field, the main pole 75 and the developing-roller-side magnetic pole 63B provided in the developing roller 63 pull each other.

The developer container 60 is provided with a brush-clipping blade 65. The brush-clipping blade 65 extends along a longitudinal direction of the magnetic roller 62 (namely in the direction perpendicular to the plane of FIG. 3). The brush-clipping blade 65 is disposed on the upstream side of a position at which the developing roller 63 faces the magnetic roller 62, in the rotational direction of the magnetic roller 62 (see the arrow 92). There is a small gap (a short distance) between the edge of the brush-clipping blade 65 and the roller surface of the magnetic roller 62.

The regulation pole 76 is attached to the magnetic-roller-side magnetic pole 62B in the state where the magnetic pole face of the regulation pole 76 faces the brush-clipping blade 65. That is, the regulation pole 76 and the brush-clipping blade 65 are disposed to face each other. The brush-clipping blade 65 is made of, for example, a non-magnetic material or a magnetic material. Since the brush-clipping blade 65 faces the regulation pole 76 of the magnetic-roller-side magnetic pole 62B, a magnetic field is generated in a gap between the brush-clipping blade 65 and the rotating sleeve 62A such that the regulation pole 76 and the brush-clipping blade 65 pull each other. With the presence of this magnetic field, the magnetic brush, which is composed of the magnetic carrier adhered with the toner, is formed between the brush-clipping blade 65 and the rotating sleeve 62A.

The developing roller 63 includes a cylindrical developing sleeve 63A (an example of the roller main body of the present disclosure) and the developing-roller-side magnetic pole 63B. The developing sleeve 63A is rotatably supported by a frame (not shown) of the developing device 41.

Figure 4:
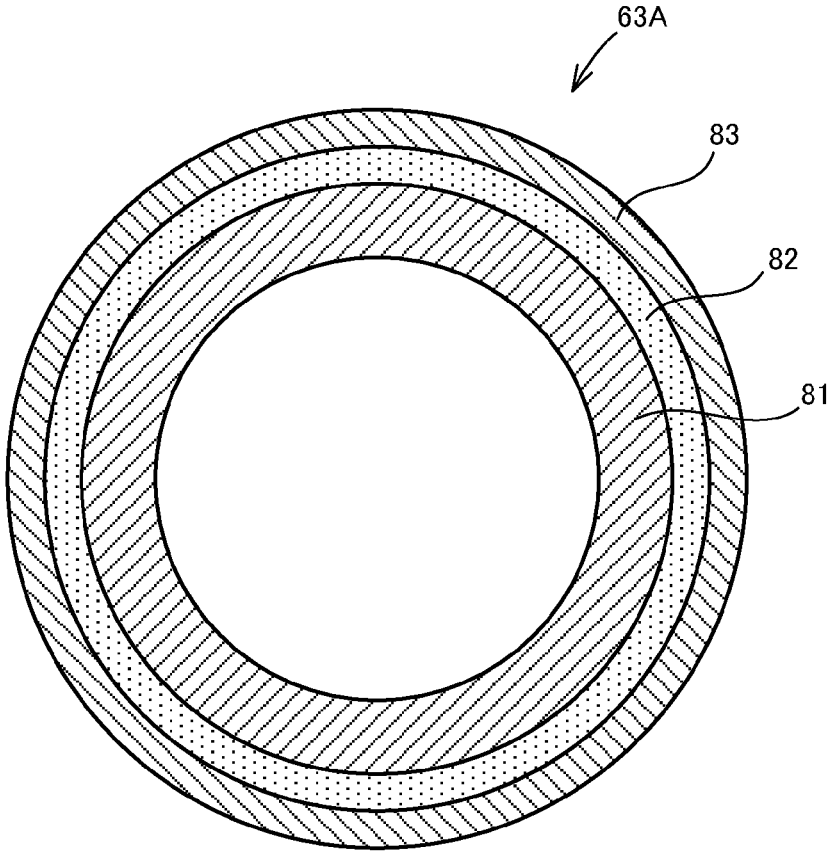
FIG. 4 is a cross sectional view showing the configuration of the developing sleeve of the developing roller included in the developing device.

As shown in FIG. 4, the developing sleeve 63A includes a cylindrical base body 81 which is a raw pipe made of aluminum, and the outer circumferential surface of the base body 81 is coated with an alumite layer 82. The alumite layer 82 is coated by the alumite treatment. The alumite treatment is also referred to as "anodic oxidation processing". In this treatment, the base body 81 of aluminum, as an electrode, is dipped into an electrolytic tank containing acidic aqueous solution of sulfuric acid or the like as the electrolytic bath (treatment bath). The electrolytic bath is electrolyzed by DC or AC, thereby an aluminum oxide coating is formed on the surface of the base body 81. With this alumite treatment, it is possible to form an aluminum oxide coating having a thickness of 5 to 100 μm on the surface of the base body 81. For example, sulfuric acid alumite, oxalic acid alumite, alumite, which is obtained by using mixed organic acids and setting the electrolyte temperature to the normal temperature, or the like is applicable as the alumite layer 82.

The surface of the alumite layer 82 is coated with a resin coat layer 83 (an example of the resin coat layer of the present disclosure) which is made of a resin material having electric conductivity. That is, in the developing sleeve 63A, the alumite layer 82 is formed on the outer circumferential surface of the base body 81, and the resin coat layer 83 is formed on the surface of the alumite layer 82. Nylon resin is used as the material of the resin coat layer 83. That is, the resin coat layer 83 is a coat layer made of nylon resin. More specifically, the resin coat layer 83 is formed from the nylon resin which contains titanium oxide in a dispersed state, wherein the titanium oxide has electric conductivity and is used as a conductive agent. The resin coat layer 83 has electric conductivity since it contains the titanium oxide.

In the present embodiment, the surface of the base body 81, which is made of aluminum and is 12 mm to 20 mm in outer diameter, is coated with the alumite layer 82 that is 10 μm in thickness, by the coating process (alumite process). Subsequently, the resin coat layer 83, which is 2 to 11 μm in thickness, is formed on the surface of the alumite layer 82 by the dipping method. The resin coat layer 83 is formed by the dipping method. As a result, when the resin coat layer 83 is equal to or larger than 10 μm in thickness, the upper and lower ends of the resin coat layer 83 become different in film thickness. In addition, when the resin coat layer 83 is equal to or larger than 12 μm in thickness, the effect of the output image onto the density unevenness becomes large, and the uniformity of the developing is decreased. Although the thickness of the alumite layer 82 can be selected as appropriate, an optimum thickness of the alumite layer 82 is 10 μm when the base body 81 is approximately 12 mm to 20 mm in diameter. The material of the resin coat layer 83 is produced by adding 50 to 150 pts.wt. of titanium oxide to 100 pts.wt. of nylon resin.

The developing sleeve 63A of the present embodiment is manufactured through the following processes. That is, the alumite layer 82 having a thickness of 10 μm is formed by allowing the outer circumferential surface of the base body 81 to be subjected to the alumite process. Subsequently, the surface of the base body 81, namely the surface of the alumite layer 82 is heated in a heating process at 120° C. for at least 10 minutes. This heating process is performed to cause cracks to occur in advance before a drying process of the resin coat layer 83 is performed, thereby preventing cracks from occurring in the drying process. The time period for which the heating process is performed is determined in advance, and is set to be more than a time period for which the drying process is performed. The heating process is always performed at a predetermined temperature for a predetermined time period. This allows an approximately constant amount of cracks to occur to each base body 81 that is subjected to the heating process. After the heating process, a process for forming the resin coat layer 83 is executed. Specifically, in this process, nylon resin as the binding resin, titanium oxide as the conductive agent, and 800 pts.wt. of methanol as the dispersed medium are mixed together with zirconia beads of 1.0 mm in diameter for approximately 48 hours by a ball mill. In the mixed liquid, the base body 81 made of aluminum having been subjected to the alumite process is soaked and then taken out. The base body 81 is then dried in a high-temperature environment of 130° C. for 10 minutes. This completes manufacturing of the developing sleeve 63A coated with the resin coat layer 83 whose thickness is 2 to 11 μm. As described above, according to the present embodiment, the alumite layer is allowed to generate cracks in the heating process before the resin coat layer 83 is coated. This prevents the conductive agent, which is contained in the resin coat layer 83, from being distributed unevenly due to a convection that occurs inside the resin coat layer 83 during the drying process of the resin coat layer 83. As a result, it is possible to form the resin coat layer 83 evenly.

As shown in FIG. 3, the developing-roller-side magnetic pole 63B is contained in the developing sleeve 63A. That is, the developing-roller-side magnetic pole 63B is provided inside the developing sleeve 63A. The developing-roller-side magnetic pole 63B is composed of, for example, a permanent magnet that generates a magnetic force, and has a different polarity from the main pole 75. As a result, the developing-roller-side magnetic pole 63B and the main pole 75 form a magnetic field in which they pull each other.

A first bias circuit 71 (see FIG. 2), which applies a DC voltage (hereinafter referred to as "Vslv[DC]") and an AC voltage (hereinafter referred to as "Vslv[AC]"), is connected to the developing sleeve 63A of the developing roller 63. A second bias circuit 72, which applies a DC voltage (hereinafter referred to as "Vmag[DC]") and an AC voltage (hereinafter referred to as "Vmag[AC]"), is connected to the rotating sleeve 62A of the magnetic roller 62. The first bias circuit 71 and the second bias circuit 72 are grounded to the same ground. The first bias circuit 71 and the second bias circuit 72 superpose the DC voltage, which is supplied from a DC power source (not shown), and the AC voltage, which is supplied from an AC power source (not shown), and apply the superposed voltage.

A voltage varying device 73 (see FIG. 2) is connected to the first bias circuit 71 and the second bias circuit 72. The voltage varying device 73 can vary the Vslv[DC] and the Vslv[AC] to be applied to the developing roller 63, and vary the Vmag [DC] and the Vmag[AC] to be applied to the magnetic roller 62.

As described above, the developer is stirred by the first stirring screw 61A and the second stirring screw 61B while being circulated in the developer container 60, wherein the toner is charged and the developer is conveyed to the magnetic roller 62 by the second stirring screw 61B. The brush-clipping blade 65 is disposed to face the regulation pole 76 of the magnetic-roller-side magnetic pole 62B. As a result, the magnetic brush is formed between the brush-clipping blade 65 and the rotating sleeve 62A. The magnetic brush on the magnetic roller 62 is regulated in layer thickness by the brush-clipping blade 65, and as the rotating sleeve 62A rotates, the magnetic brush moves to a position at which it faces the developing roller 63. At this position, a magnetic field is imparted to the magnetic brush, in which the main pole 75 of the magnetic-roller-side magnetic pole 62B and the developing-roller-side magnetic pole 63B pull each other. This causes the magnetic brush to be contacted with the roller surface of the developing roller 63. As a result, the toner having been adhered to the magnetic carrier of the magnetic brush is transferred to the developing roller 63. In addition, due to the magnetic field and a potential difference ΔV between Vmag [DC] applied to the magnetic roller 62 and Vslv[DC] applied to the developing roller 63, a toner thin layer is formed on the roller surface of the developing roller 63. It is noted that the toner thin layer on the developing roller 63 varies in thickness as the potential difference ΔV is adjusted by the voltage varying device 73.

The toner thin layer formed on the developing roller 63 via the magnetic brush is conveyed, as the developing roller 63 rotates, to a position where the photoconductor drum 11 and the developing roller 63 face each other. Since a voltage including an AC component has been applied to the developing sleeve 63A of the developing roller 63, toner flies toward the photoconductor drum 11 due to the potential difference (developing bias) between the developing roller 63 and the photoconductor drum 11. At this time, the toner reciprocates actively between the photoconductor drum 11 and the developing sleeve 63A due to an AC electric field formed by the AC voltage applied to the developing sleeve 63A. Toner that has reached the electrostatic latent image on the photoconductor drum 11 adheres to and develops the electrostatic latent image. On the other hand, toner reciprocating between the developing sleeve 63A and a non-image area other than the electrostatic latent image is returned to the developing sleeve 63A without adhering to the non-image area.

When the rotating sleeve 62A of the magnetic roller 62 further rotates clockwise, the magnetic brush is separated from the roller surface of the developing roller 63 due to a magnetic field in a horizontal direction (a circumferential direction of the roller) that is generated by the carrying pole 77 that is adjacent to the main pole 75. As a result, toner, which remains without being used in the developing, is collected from the developing roller 63 onto the rotating sleeve 62A. When the rotating sleeve 62A further rotates, a magnetic field is imparted in which the peeling pole 78 and the draw-up pole 79 of the magnetic-roller-side magnetic pole 62B, both having the same polarity, repel each other. This causes the toner to be separated from the rotating sleeve 62A in the developer container 60. The toner and the magnetic carrier are then stirred and conveyed by the second stirring screw 61B, drawn up again by the draw-up pole 79 and held on the rotating sleeve 62A as a two-component developer having appropriate toner density and having been uniformly charged. The magnetic brush is then formed and conveyed to the brush-clipping blade 65.

Meanwhile, the developing device 41 is required to have high developability and contamination resistance, wherein the developability represents the ability to develop the electrostatic latent image on the photoconductor drum 11 with the toner, and the contamination resistance represents the resistance against roller contamination in the developing sleeve 63A. Conventionally, the developability of the developing device 41 has been evaluated only by the volume resistance value of the developing sleeve 63A. The volume resistance value has a proportional relationship with the evaluation of the developability, and thus has been used conventionally as an index for evaluating the developability. However, the volume resistance value does not have any relationship with the contamination resistance that indicates the roller contamination, and thus cannot be used for the evaluation of the contamination resistance. In view of this, the inventors have made intensive studies and found that the developability is affected by resistance component Rs [Ω] in AC impedance Z [Ω] of the developing sleeve 63A and that the roller contamination is affected by electrostatic capacitance component Cs [F] in the AC impedance Z [Ω] of the developing sleeve 63A. That is, the inventors found, from an experiment described below, that the resistance component Rs [Ω] and the electrostatic capacitance component Cs [F] in the AC impedance Z [Ω] of the developing sleeve 63A can be used as indexes that have relationships with the developability and the contamination resistance, and that in particular, a value "Rs·Cs", which is a product of the resistance component Rs and the electrostatic capacitance component Cs, can be used as such an index.

The AC impedance Z indicates an electrical resistance observed when an AC voltage is supplied to the base body 81 of the developing sleeve 63A, and is represented by the following equation (1) in which the resistance component Rs and the electrostatic capacitance component Cs of the developing sleeve 63A are used.

[Equation 1]

$$Z^2 = Rs^2 + \left(\frac{1}{2\pi f \cdot Cs}\right)^2 \quad (1)$$

The usability of the electrostatic capacitance component Cs can be verified based on the fact that the roller contamination is closely related to the image force (adhesiveness) of the toner to the developing sleeve 63A. When the image force is decreased, the adhesiveness of the toner is decreased, and the toner is easily separated from the developing sleeve 63A. It is thus considered that the roller contamination is restricted and the contamination resistance is improved. In general, the image force Fi is represented by the following equation (2), wherein a denotes the correction coefficient, $\in_r$ denotes the dielectric constant of the developing sleeve 63A, $\in_0$ denotes the dielectric constant of vacuum, q denotes the charge quantity of the toner, and D denotes the diameter of the toner.

[Equation 2]

$$Fi = \alpha \times \frac{(\varepsilon_r - 1)}{(\varepsilon_r + 1)} \times \frac{q^2}{4\pi\varepsilon_0 D^2} \quad (2)$$

The Equation 2 indicates that, when the dielectric constant $\in_r$ is small, namely, when the dielectric constant $\in$ of the medium of the developing sleeve 63A is small, the image force Fi is small. The electrostatic capacitance Cs of the developing sleeve 63A is represented by "$\in$·S/d", and Cs is decreased with decrease of dielectric constant $\in$. As a result, it is verified that, with the decrease of the electrostatic capacitance Cs of the developing sleeve 63A, the image force becomes smaller and the roller contamination is reduced.

In the following, optimal values of the value Rs·Cs are explained with reference to FIGS. 5, 6A and 6B. FIG. 5 is a table showing comparative examples 1 to 3 (CF1-3) and examples 1 to 17 (EX1-17) of the Developing sleeve 63A. Specifically, for each example and comparative example, developing sleeves 63A, which are different in various elements such as: content of titanium oxide; type of resin coat; thickness of resin coat; presence or absence of acetylene black (carbon black) as a reinforcing additive; and surface roughness Ra of the resin coat layer 83, were prepared, and the AC impedance Z, resistance component Rs, electrostatic capacitance component Cs, and the value Rs·Cs were obtained for each of the examples and comparative examples.

Figure 6B:
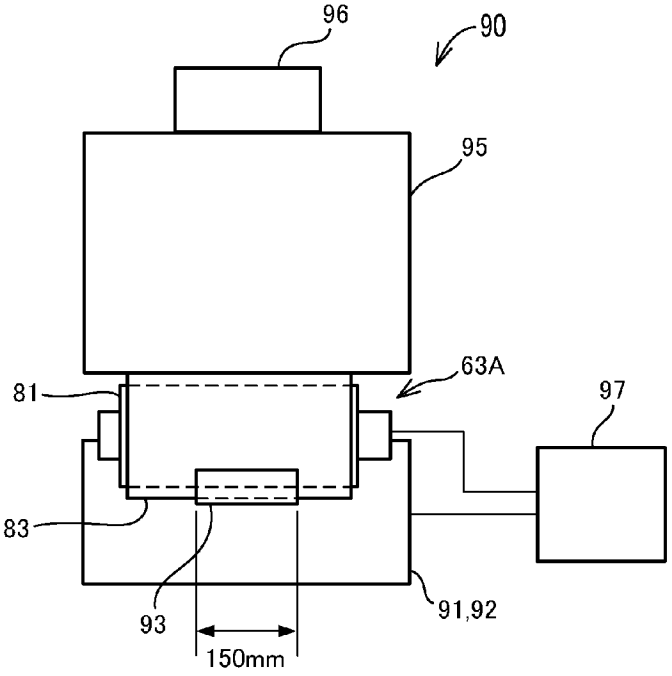
FIGS. 6A and 6B are diagrams showing an experimental device for measuring AC impedance Z, resistance component Rs, electrostatic capacitance component Cs of the developing sleeve.
Figure 6A:
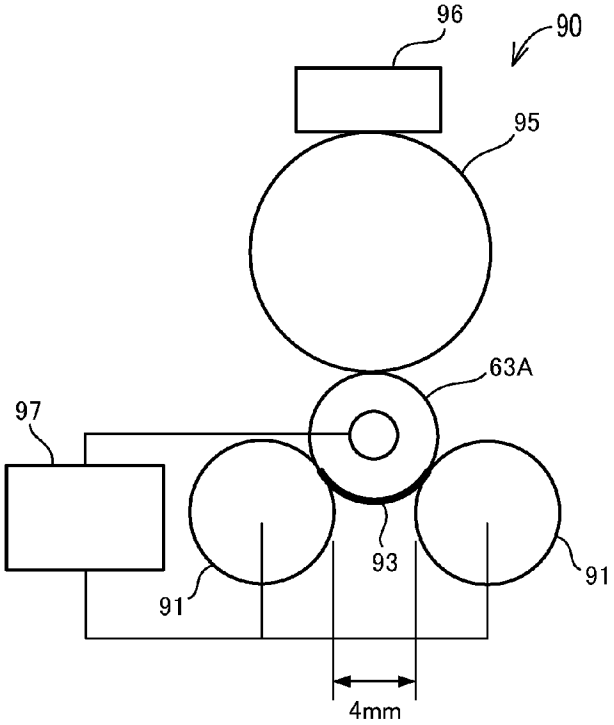

FIGS. 6A and 6B are diagrams showing an experimental device 90 for measuring the AC impedance Z, resistance component Rs, electrostatic capacitance component Cs of the developing sleeve 63A. The experimental device 90 includes two SUS rollers 91, 92 which are made of stainless and each 18 mm in diameter and aligned in the horizontal direction with an interval of 4 mm therebetween. A film electrode 93 (150 mm long in the horizontal direction) made of aluminum is suspended between the SUS rollers 91, 92. The developing sleeve 63A (comparative examples 1 to 3, examples 1 to 17), which is the target of the experiment, is disposed such that the roller surface thereof is closely contacted with the upper surface of the film electrode 93. Furthermore, a SUS roller 95 of 30 mm in diameter is disposed above the developing sleeve 63A. A load is applied to the SUS roller 95 by a weight 96 of 500 g, and the load is applied to the developing sleeve 63A via the SUS roller 95. It is noted that the roller bodies including the developing sleeve 63A are subject to the experiment in the state where they are not rotated. The two SUS rollers 91, 92 are connected to an electrode of an impedance measuring instrument 97 (LCR HiTESTER 3522 made by Hioki E.E. Corporation), and the base body 81 of the developing sleeve 63A is connected to the other electrode of the impedance measuring instrument 97. The impedance measurement by the impedance measuring instrument 97 is performed in this state. In this experiment, an AC voltage (sine wave) with a voltage of 5.0 V is applied to both ends of the impedance measuring instrument 97. By varying the frequency of the applied AC voltage, the AC impedance Z, resistance component Rs, and electrostatic capacitance component Cs of the developing sleeve 63A are measured. The measurement is performed a plurality of times (twice to 16 times), and the average values of the measured values are shown in the table of FIG. 5 as the experiment results. It is noted that when the frequency of the applied AC voltage varies, the AC impedance Z changes, but the resistance component Rs and the electrostatic capacitance component Cs do not change.

Furthermore, from the results of monochrome image formation on a print sheet by using the developing device 41 in which the developing sleeve 63A of each example shown in FIG. 5 has been installed, evaluation was made on the developability, contamination resistance, and half reproducibility, and the evaluation results are shown in the table of FIG. 5. Here, the developability was evaluated with regard to the uniformity of the developing. Specifically, images were formed as half-density images with a print rate of 25%, the images were observed visually, and evaluated as ○ (Good) when there was no density unevenness, Δ (Fair) when there was a slight density unevenness, and x (Poor) when a significant density unevenness occurred. With regard to the contamination resistance, images were formed as solid monochrome images painted out 100%, and the images were observed visually and evaluated as ○ (Good) when there was almost no influence of contamination, Δ (Fair) when there was a slight influence of contamination but the image was not influenced greatly, and x (Poor) when an influence of contamination was clearly observed on the image. In addition, images were formed as half-density images with a low print rate (6.25% per dot), and the images were evaluated on the reproducibility of the image (half reproducibility). With regard to the half reproducibility, the evaluation was made after performing printing continuously on 10,000 print sheets of A4 size by using a print pattern with the B/W ratio of 4.2%. With regard to the half reproducibility, the images were observed visually, and evaluated as ○ (Good) when the reproducibility was good, or x (Poor) when the reproducibility was poor.

It is noted that in evaluating the developability, contamination resistance, and half reproducibility, the images were formed under the following conditions. As the specific conditions, the print speed was 30 sheets/minute, the circumferential speed of the photoconductor drum 11 was 180 mm/second, the distance between the photoconductor drum 11 and the developing sleeve 63A was 0.12 mm, the frequency of the AC voltage applied as the developing bias was 3.7 kHz, and the weight ratio of the toner and the carrier was 9%.

Among the comparative examples 1 to 3 shown in FIG. 5, there is no comparative example that was evaluated as "good" in both developability and contamination resistance. In addition, all the comparative examples were evaluated as "poor" in half reproducibility. On the other hand, the examples 1 to 17 were evaluated as "fair" or "good" in both developability and contamination resistance, and were evaluated as "good" in half reproducibility. As apparent from the table shown in FIG. 5, both the developability and the contamination resistance of the developing sleeve 63A are fair or good when the value Rs·Cs is in the range from being equal to or higher than $2.79\times10^{-7}$ (see example 8 in FIG. 5) to being equal to or lower than $6.77\times10^{-5}$ (see example 17 in FIG. 5). Furthermore, all of the developability, contamination resistance, and half reproducibility of the developing sleeve 63A are good, and the printing performance is excellent when the value Rs·Cs is in the range from being equal to or higher than $2.79\times10^{-7}$ (see example 8 in FIG. 5) to being equal to or lower than $2.24\times10^{-5}$ (see example 1 in FIG. 5). This means that the value Rs·Cs is effective as an index for objectively evaluating both of the developability and the contamination resistance. In addition, the value Rs·Cs is effective as an index for objectively evaluating the half reproducibility. As a result, it is possible to realize the developing roller 63 which is excellent in the developability and the contamination resistance, and also in the half reproducibility as well, by using the value Rs·Cs as a new index and configuring the developing sleeve 63A such that the value Rs·Cs is in the above-mentioned range.

The value Rs·Cs, the new index, represents a time constant in the case where the developing sleeve 63A to which an AC voltage was applied is regarded as an equivalent circuit of resistances and capacitors. In general, the smaller the time constant is, the faster the rise and fall of the rectangular wave AC voltage are. In addition, the faster the rise and fall of the rectangular wave AC voltage are, the longer the time period for which the maximum value of the AC voltage is applied is. This activates the reciprocal movement of the toner between the photoconductor drum 11 and the developing device 41 due to the AC electric field. In that case, such a half-density image that includes an isolated 1-dot image becomes good in developability, even when the potential difference from the electrostatic latent image is as small as when a half-density image is formed. When the chargeability of the toner is decreased due to, in particular, the aged deterioration or the like, or when the chargeability of the photoconductor drum 11 is decreased, if the time constant is great, the toner does not reciprocate fully, and the developability of the half image is deteriorated. In view of these, according to the present embodiment, the resistance component Rs and the electrostatic capacitance component Cs in AC impedance Z are not evaluated individually, but the product thereof is used as an index and its uppermost value is set to $6.77\times10^{-5}$ based on the experiment. This realizes the developing roller 63 that is excellent in developability and contamination resistance even if the toner or the photoconductor drum 11 is decreased in chargeability.

In addition, it is understood from the table shown in FIG. 5 that, among the examples 1 to 17 in which the value Rs·Cs is in the range from the lowermost value $2.79\times10^{-7}$ to the uppermost value $6.77\times10^{-5}$, the maximum value of the surface roughness Ra is 0.279 μm (see example 8) and the minimum value is 0.057 μm (see example 4). It can be said from this that the surface roughness Ra of the resin coat layer 83 of the developing sleeve 63A is preferably in the range from 0.057 μm to 0.279 μm. When the surface roughness Ra is too low, the toner becomes easy to separate, and a toner fogging easily occurs. On the other hand, when the surface roughness Ra is too high, the toner becomes difficult to separate, and a roller contamination may occur. According to the value Rs·Cs and the evaluations shown in FIG. 5, when the surface roughness Ra of the resin coat layer 83 is in the range from 0.057 μm to 0.279 μm, it is possible to realize the developing sleeve 63A that is highly evaluated.

According to the above-described embodiment, the magnetic brush is used to form the toner layer on the developing sleeve 63A of the developing device 41. However, not limited to such a toner forming method, the present disclosure is applicable to other toner forming methods. In addition, the above-described embodiment explains, as an example, the developing device 41 that performs the developing by using a two-component developer. However, the present disclosure is applicable to developing devices and developing rollers that use a one-component developer whose main component is toner.

Furthermore, the above-described embodiment explains, as an example, the developing sleeve 63A in which the alumite layer 82 is formed on the base body 81, and the resin coat layer 83 is further formed thereon. However, the present disclosure is applicable to the developing sleeve 63A in which the resin coat layer 83 is directly formed on the base body 81, without forming the alumite layer 82.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing roller comprising:

a roller main body disposed to face, without contact, an outer circumferential surface of an image carrier, wherein a resin coat layer has been formed on an outer circumferential surface of the roller main body, the resin coat layer being made of a resin material having electric conductivity, and a product of resistance component Rs [Ω] and electrostatic capacitance component Cs [F] in AC impedance Z of the roller main body is in a range from $2.79\times10^{-7}$ to $6.77\times10^{-5}$, the AC impedance Z being obtained when an AC voltage of a predetermined frequency f is applied.

2. The developing roller according to claim 1, wherein the product of the resistance component Rs [Ω] and the electrostatic capacitance component Cs [F] in the AC impedance Z of the roller main body is in a range from $2.79\times10^{-7}$ to $2.24\times10^{-5}$.

3. The developing roller according to claim 1, wherein in the roller main body, an alumite layer has been formed on an outer circumferential surface of a base body made of a metal including aluminum, and a resin coat layer has been formed on a surface of the alumite layer.

4. The developing roller according to claim 1, wherein the resin coat layer is in a range from 2.0 μm to 11.0 μm in thickness.

5. The developing roller according to claim 1, wherein the resin coat layer is formed from nylon resin which contains titanium oxide in a dispersed state.

6. The developing roller according to claim 1, wherein the roller main body is in a range from 12 mm to 20 mm in outer diameter.

7. The developing roller according to claim 1, wherein surface roughness Ra of the resin coat layer of the roller main body is in a range from 0.057 μm to 0.279 μm.

8. The developing roller according to claim 1, wherein the AC voltage applied to the roller main body is a sine wave of 5 V, and the frequency f is 3.7 kHz.

9. A developing device comprising:

the developing roller according to claim 1; and a magnetic roller configured to form a toner layer on a surface of the developing roller via a magnetic brush composed of toner and magnetic carrier.

10. An image forming apparatus comprising the developing device according to claim 9.

* * * * *